US011571825B2

(12) United States Patent
Chen et al.

(10) Patent No.: US 11,571,825 B2
(45) Date of Patent: Feb. 7, 2023

(54) UTILITY KNIFE

(71) Applicants: MING SHIN TOOLS CO., LTD., Taichung (TW); Yung-Shun Chen, Taichung (TW); Cheng-Chou Wu, Taichung (TW)

(72) Inventors: Yung-Shun Chen, Taichung (TW); Cheng-Chou Wu, Taichung (TW)

(73) Assignees: MING SHIN TOOLS CO., LTD., Taichung (TW); Yung-Shun Chen, Taichung (TW); Cheng-Chou Wu, Taichung (TW)

( * ) Notice: Subject to any disclaimer, the term of this patent is extended or adjusted under 35 U.S.C. 154(b) by 169 days.

(21) Appl. No.: 17/117,725

(22) Filed: Dec. 10, 2020

(65) Prior Publication Data

US 2022/0184826 A1 Jun. 16, 2022

(51) Int. Cl.
*B26B 5/00* (2006.01)
*B25G 1/08* (2006.01)

(52) U.S. Cl.
CPC ..... *B26B 5/003* (2013.01); *B25G 1/08* (2013.01)

(58) Field of Classification Search
CPC ..... B26B 5/003; B25G 1/08
See application file for complete search history.

(56) References Cited

U.S. PATENT DOCUMENTS

| | | | | |
|---|---|---|---|---|
| 3,577,637 | A * | 5/1971 | Braginetz | B26B 5/001 30/162 |
| 8,220,161 | B2 * | 7/2012 | Chang | B26B 5/001 30/162 |
| 9,205,569 | B2 * | 12/2015 | Garavaglia | B26B 5/001 |
| 2003/0037444 | A1 | 2/2003 | Chunn | |
| 2007/0074402 | A1 | 4/2007 | Hernandez et al. | |
| 2019/0077032 | A1 * | 3/2019 | Squiers | B26B 1/046 |
| 2021/0146557 | A1 * | 5/2021 | Ranieri | B26B 5/003 |

FOREIGN PATENT DOCUMENTS

| | | |
|---|---|---|
| TW | I309197 A | 12/2006 |
| TW | M478597 U | 5/2014 |

* cited by examiner

*Primary Examiner* — Omar Flores Sanchez
(74) *Attorney, Agent, or Firm* — Muncy, Geissler, Olds & Lowe, P.C.

(57) ABSTRACT

A utility knife is provided, including: a housing, defining an operation compartment and a storage compartment; a blade holder, movably received within the operation compartment; a blade storing carrier, movably received within the storage compartment, including a receiving portion for receiving at least one spare blade and a grip portion; and a locking mechanism, including a base body, a movable member, a first engaging member and a second engaging member, the base body being disposed to the housing, the movable member being attached to the base body and movable between a locking position and a release position, the first engaging member being disposed on and movable with the movable member, the first engaging member and the second engaging member are releasably engaged with each other so that the blade storing carrier is detachable from the housing.

8 Claims, 10 Drawing Sheets

UTILITY KNIFE

BACKGROUND OF THE INVENTION

Field of the Invention

The present invention relates to a utility knife.

Description of the Prior Art

Utility knife is shaped to be suitable for one-handed grasping, and commonly used to cut thin materials such as paper, tape, fabric, etc. Utility knife is usually used in the fields such as processing factories, warehouses. TWI309197, TWM478597, US2007074402A1 and US2003037444A1 each disclose a utility knife.

However, the blade storing carrier of the aforementioned utility knife used to store spare blades has shortcomings in practical use. For example, the blade storing carrier of TWI309197 is pivotally connected to and received within the housing, which is hard to be gripped to be open. The blade storing carrier of TWI309197 is connected to the housing in tight fitting; however, after being used for a long period, the blade storing carrier can disengage from the housing. The blade storing carrier of US2003037444A1 can be opened in several ways; however, there are problems such as unintending opening of the pivotal cover, easy detachment of the blade as the blade is spread out; as to US2007074402A1, it has the problem of cover missing.

The present invention is, therefore, arisen to obviate or at least mitigate the above-mentioned disadvantages.

SUMMARY OF THE INVENTION

The main object of the present invention is to provide a utility knife having a blade storing carrier which is configured for carrying at least one spare blade and withdrawable.

To achieve the above and other objects, a utility knife is provided, including: a housing, defining an operation compartment and a storage compartment; a blade holder, movably received within the operation compartment, configured to carry and hold a blade; a blade storing carrier, movably received within the storage compartment, including a receiving portion and a grip portion which are connected with each other, the receiving portion configured to receive at least one spare blade, the grip portion being protrusive out of the housing; and a locking mechanism, including a base body, a movable member, a first engaging member and a second engaging member, the base body being disposed to the housing, the movable member being attached to the base body and movable between a locking position and a release position, the first engaging member being disposed on and movable with the movable member, the second engaging member being disposed on the blade storing carrier, one of the first engaging member and the second engaging member including a slot, the other of the first engaging member and the second engaging member including a projection which is releasably engaged within the slot; wherein when the movable member is located in the locking position and the projection is engaged within the slot, the blade storing carrier is undetachable from the housing, and when the movable member is located in the release position and the projection is disengaged from the slot, the blade storing carrier is detachable from the housing.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
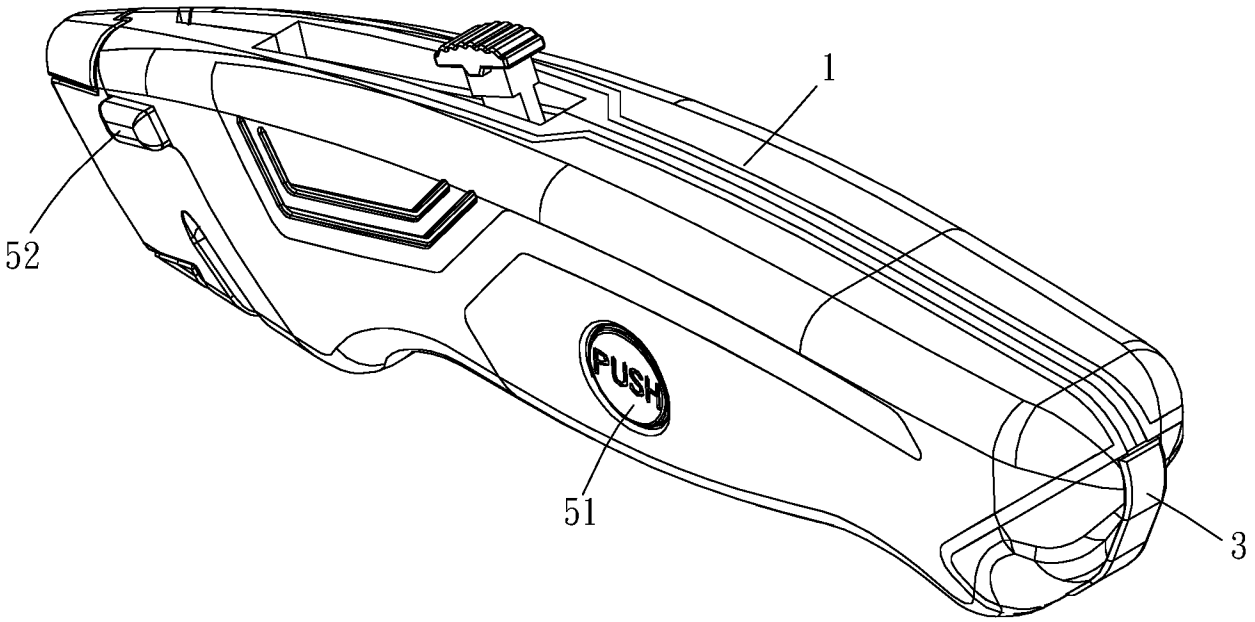
FIGS. 1 and 2 are stereograms of a preferable embodiment of the present invention.
Figure 2:
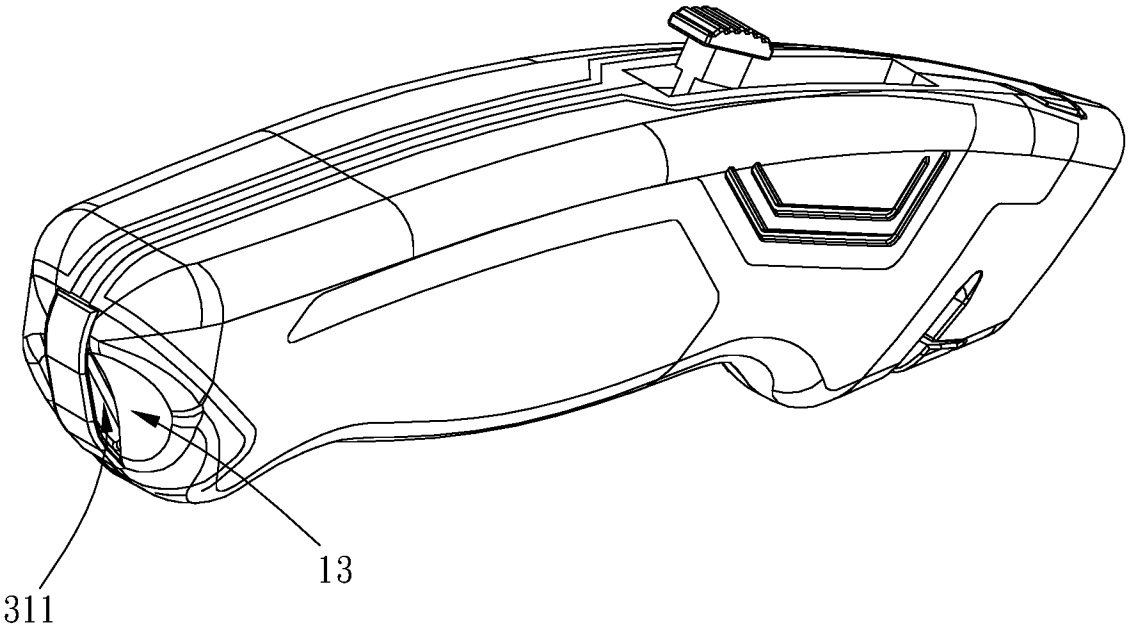
Figure 3:
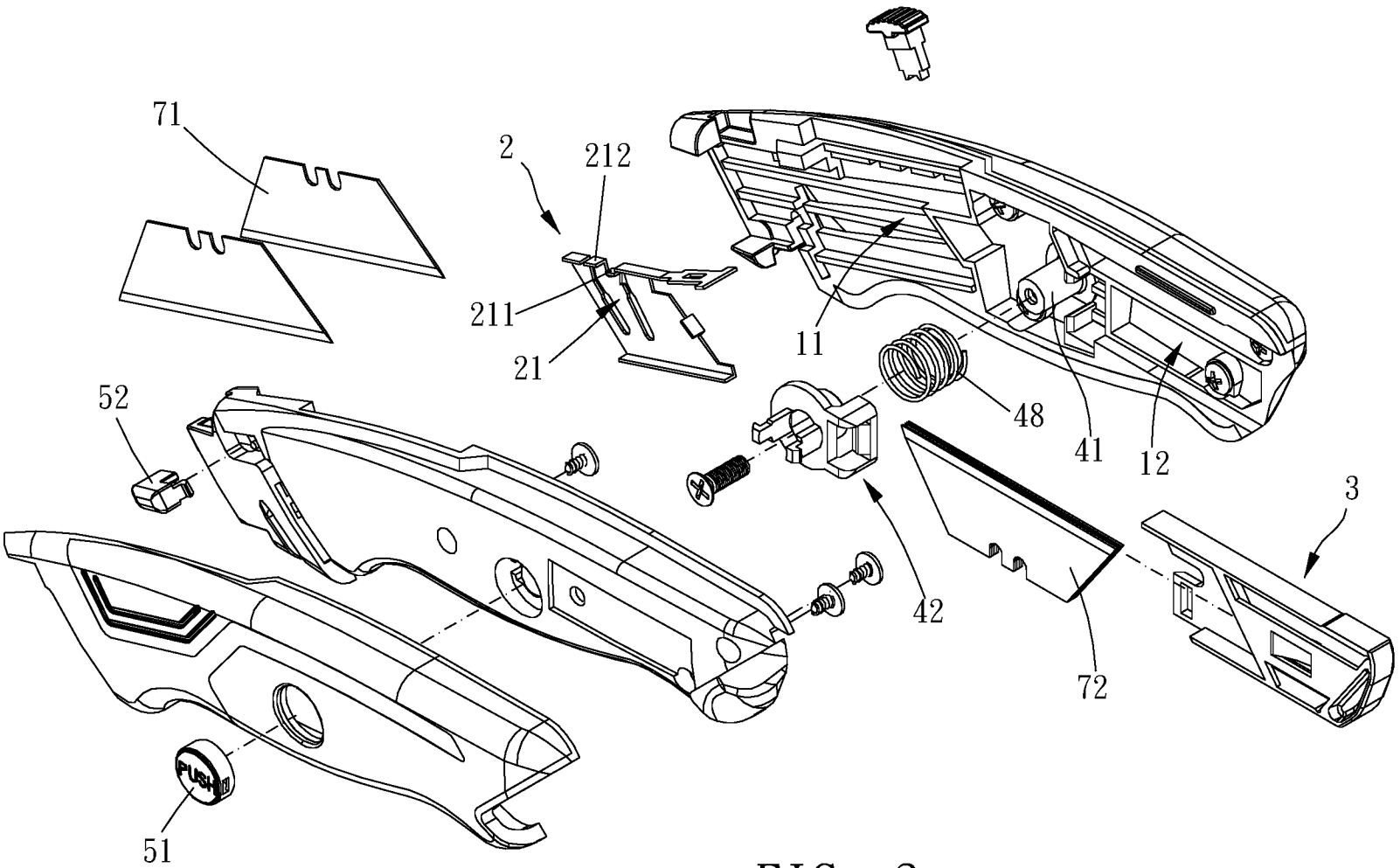
FIG. 3 is a breakdown drawing of a preferable embodiment of the present invention.
Figure 5:
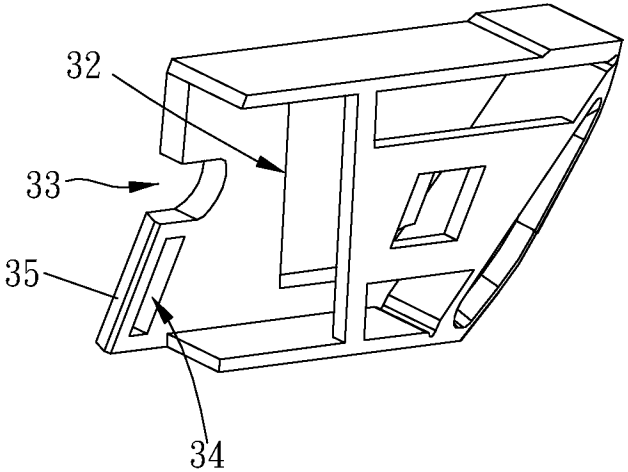
FIGS. 4 and 5 are stereograms of a blade storing carrier according to a preferable embodiment of the present invention.
Figure 4:
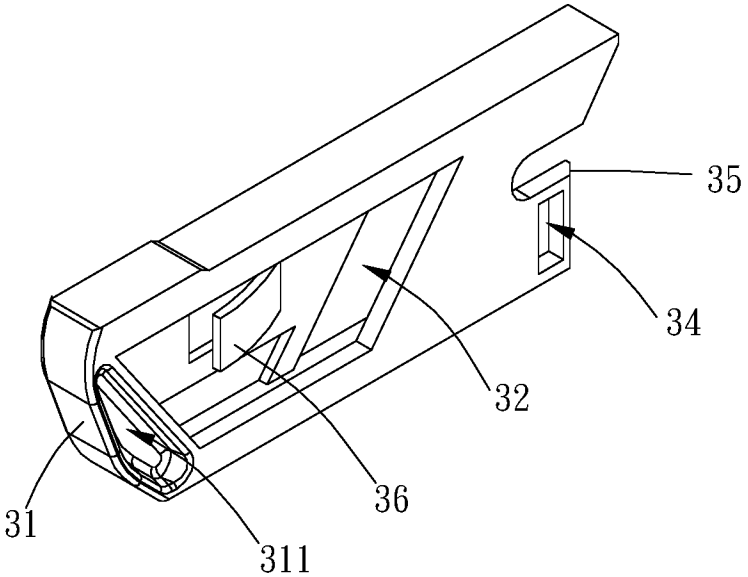
Figure 6:
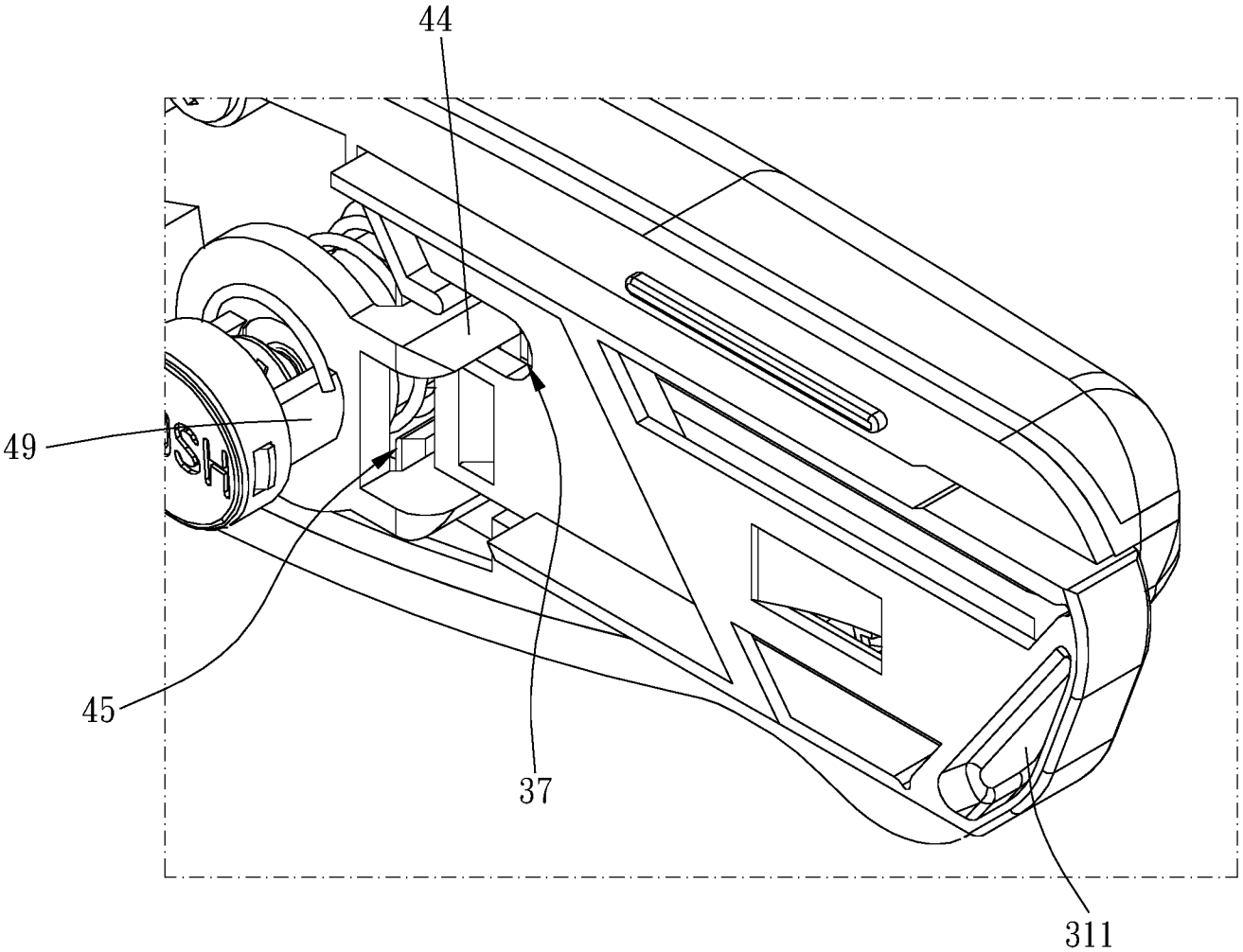
FIG. 6 is a partial enlargement of a preferable embodiment of the present invention.
Figure 7:
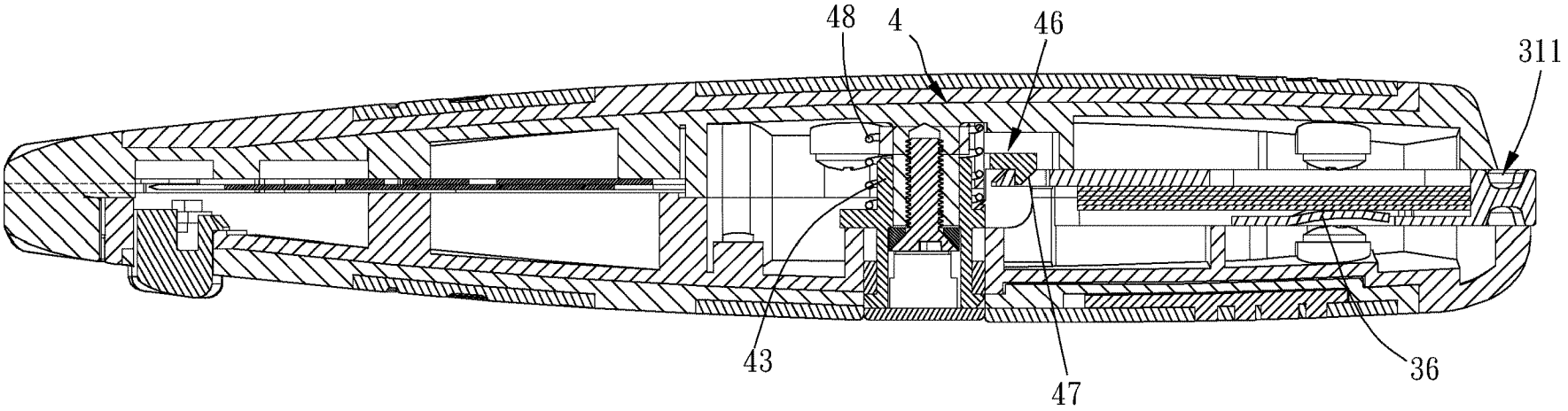
FIGS. 7 and 8 are cross-sectional views showing operation of a locking mechanism according to a preferable embodiment of the present invention.
Figure 8:
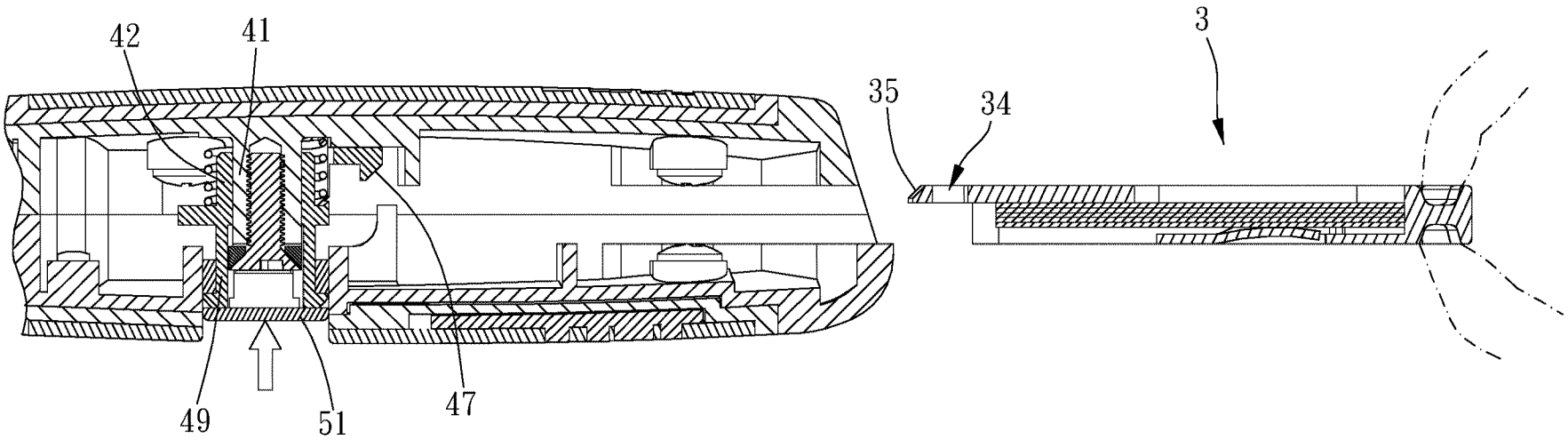
Figure 9:
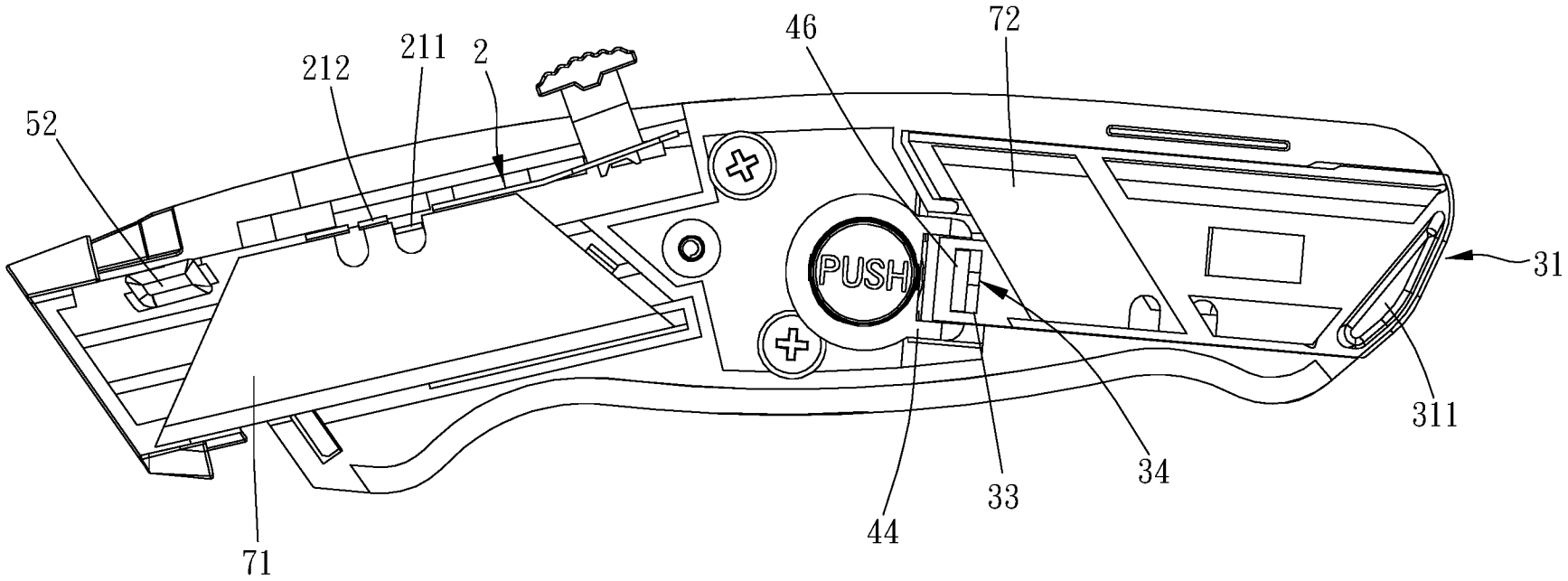
FIGS. 9 and 10 are drawings showing movement of a blade holder according to a preferable embodiment of the present invention.
Figure 10:
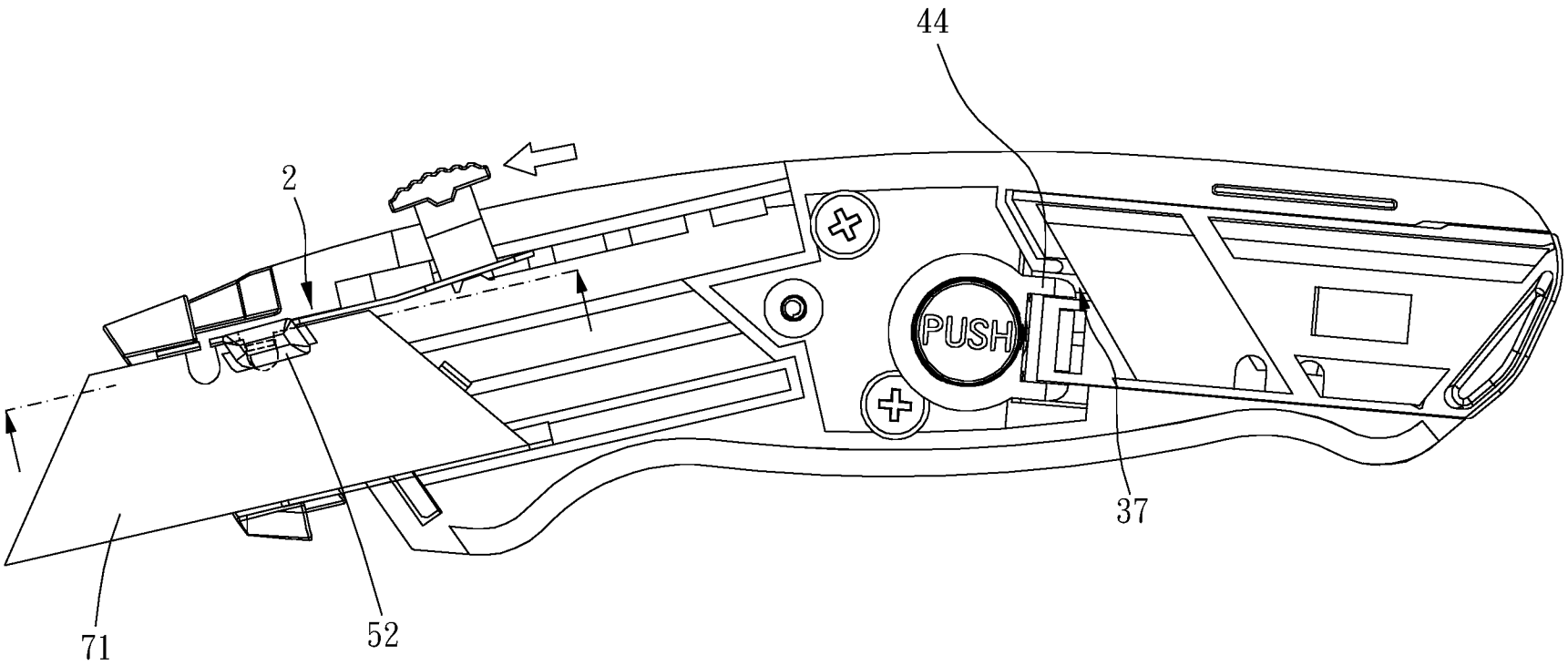
Figure 11:
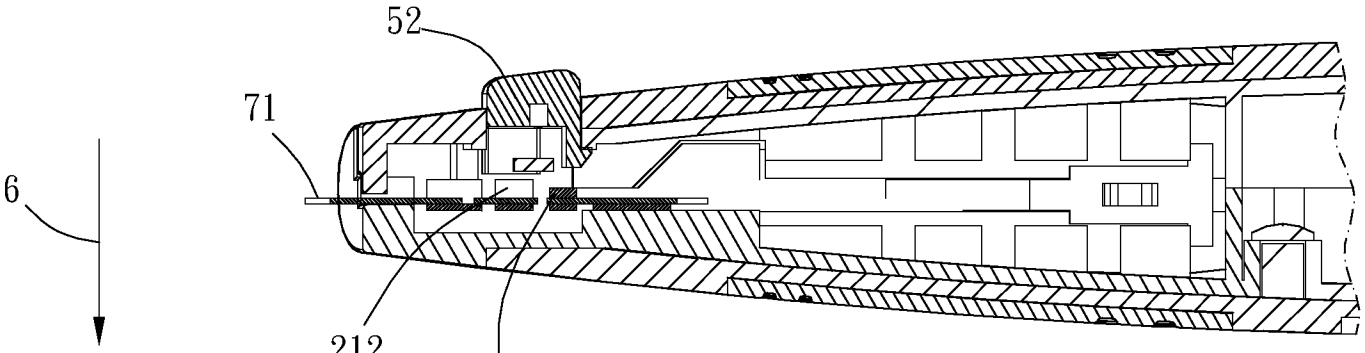
FIGS. 11 and 12 are drawings showing operation of a trigger button according to a preferable embodiment of the present invention.
Figure 12:
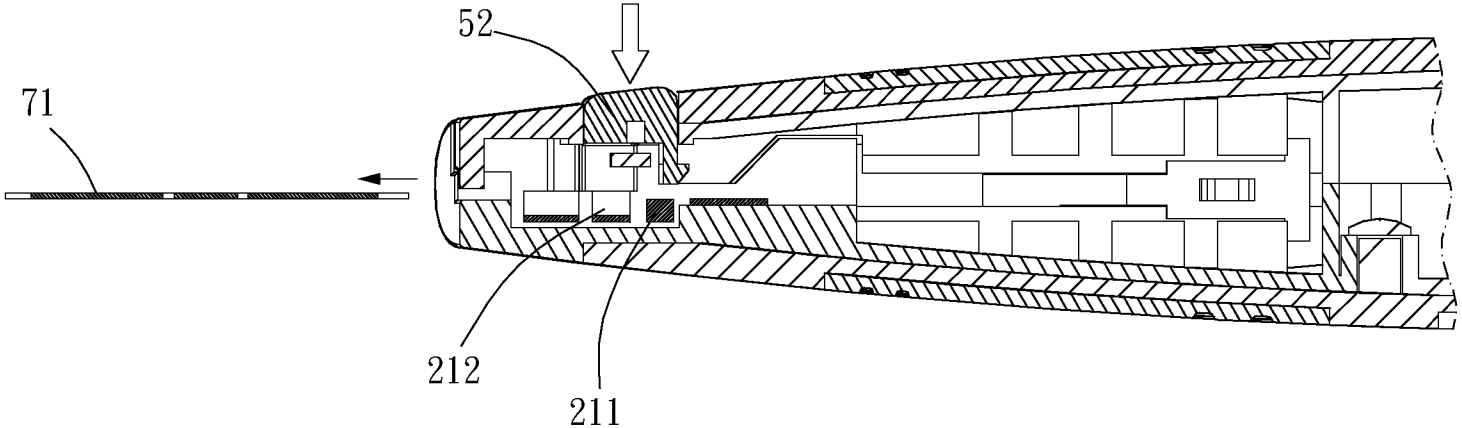

Please refer to FIGS. 1 to 12 for a preferable embodiment of the present invention. A utility knife 1 of the present invention includes a housing 1, a blade holder 2, a blade storing carrier 3 and a locking mechanism 4.

The housing 1 defines an operation compartment 11 and a storage compartment 12. The blade holder 2 is movably received within the operation compartment 11 and configured to carry and hold a blade 71. The blade storing carrier 3 is movably received within the storage compartment 12. The blade storing carrier 3 includes a receiving portion 32 and a grip portion 31 which are connected with each other, the receiving portion 32 is configured to receive at least one spare blade 72, and the grip portion 31 is protrusive out of the housing 1 for external gripping. The locking mechanism 4 includes a base body 41, a movable member 42, a first engaging member and a second engaging member. The base body 41 is disposed to the housing 1, the movable member 42 is attached to the base body 41 and movable between a locking position and a release position, the first engaging member is disposed on and movable with the movable member 42, and the second engaging member is disposed on the blade storing carrier 3. One of the first engaging member and the second engaging member includes a slot 34, and the other of the first engaging member and the second engaging member includes a projection 46 which is releasably engaged within the slot 34. When the movable member 42 is located in the locking position and the projection 46 is engaged within the slot 34, the blade storing carrier 3 is undetachable from the housing 1, and when the movable member 42 is located in the release position and the projection 46 is disengaged from the slot 34, the blade storing carrier 3 is detachable from the housing 1.

Preferably, the locking mechanism 4 further includes an elastic member 48, and the elastic member 48 is disposed between the housing 1 and the movable member 42 so that the movable member 42 is biased in a direction toward the locking position, which ensures that the blade storing carrier 3 is normally located in the locking position.

In this embodiment, the first engaging member includes the projection 46, the second engaging member includes the slot 34, the projection 46 is hook-shaped and includes a first inclined portion 47, and the blade storing carrier 3 further includes a second inclined portion 35 facing the first inclined portion 47. When the blade storing carrier 3 is inserted into the storage compartment 12 in a direction toward the base body 41, the first inclined portion 47 and the second inclined portion 35 slide relative to each other so that the movable member 42 moves toward the release position, with cooperation of the elastic member 48 the blade storing carrier 3 can be automatically locked. The movable member 42 and the base body 41 are slidably sleeved with each other, and the movable member 42 is slidable in a direction transverse to a direction in which the blade storing carrier 3 is withdrawn.

Specifically, the movable member 42 further includes a sleeve body 43 and two arm portions 44, the sleeve body 43 is disposed around the base body 41, the two arm portions 44 are separate and connected with the sleeve body 43, the projection 46 is disposed between the two arm portions 44, and the two arm portions 44 and the projection 46 define an insertion space 45. The movable member 42 includes two claws 49 disposed through the housing 1 and connected with a press button 51, the two claws 49 are connected with the sleeve body 43, and the press button 51 is externally operable for quick release. The blade storing carrier 3 further includes an insertion section 33, the insertion section 33 and the grip portion 31 are respectively located at opposite ends of the blade storing carrier 3, and the slot 34 is disposed through the insertion section 33. The second inclined portion 35 is disposed on a side of the insertion section 33 opposite the grip portion 31, and the insertion section 33 is insertable within the insertion space 45 so that the projection 46 is engaged within the slot 34. The cooperation of the insertion space 45 and the insertion section 33 can facilitate accurate engagement thereof and is foolproof.

Specifically, the receiving portion 32 is located at an end of the blade storing carrier 3 remote from the grip portion 31, the insertion section 33 projects out of the receiving portion 32, and the receiving portion 32 is open at a side thereof opposite the grip portion 31 and includes a notch 37. When the insertion section 33 is inserted in the insertion space 45, one of the two arm portions 44 is located within the notch 37 and within the receiving portion 32 and is configured to block and restrict the at least one spare blade 72, which keeps the at least one spare blade 72 and the blade holder 2 stable.

Preferably, the blade storing carrier 3 further includes an urging portion 36, and the urging portion 36 extends within the receiving portion 32 and is configured to urge and abuts the at least one spare blade 72, for sufficiently securing the at least one spare blade 72. In this embodiment, the urging portion 36 includes a tab which is elastically deformable.

Preferably, the grip portion 31 includes at least one recess 311 configured for gripping by the finger(s), In this embodiment, the at least one recess includes two recesses 311, and the two recesses 311 are respectively disposed at opposite sides of the grip portion 31.

Preferably, the housing 1 further includes an arcuate concave 13, the arcuate concave 13 extends in a direction lateral to a direction in which the recess 311 extends, which provides more space for easy gripping.

The utility knife further includes a trigger button 52, and the trigger button 52 is mounted to the housing 1 and movable in a first direction 6. The blade holder 2 includes a deformable portion 21, and the deformable portion 21 is resiliently deformable in the first direction 6. The deformable portion 21 includes a positioning portion 211 and a trigger portion 212, the positioning portion 211 is configured to be connected with and hold the blade 71, and the trigger portion 212 is configured to be arranged to extend over the blade 71. It is noted that the blade holder 2 is movable to a predetermined position in a direction transvers to the first direction 6. When the blade holder 2 is located in the predetermined position, the trigger portion 212 is located on a moving path in which the trigger button 52 moves, the trigger button 52 is configured to be pressed to press and deform the trigger portion 212 so that the deformable portion 21 is disengaged from the blade 71, so the blade 71 is withdrawable for turning or replacement of the blade 71.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A utility knife, including:

a housing, defining an operation compartment and a storage compartment;

a blade holder, movably received within the operation compartment, configured to carry and hold a blade;

a blade storing carrier, movably received within the storage compartment, including a receiving portion and a grip portion which are connected with each other, the receiving portion configured to receive at least one spare blade, the grip portion being protrusive out of the housing; and a locking mechanism, including a base body, a movable member, a first engaging member and a second engaging member, the base body being disposed to the housing, the movable member being attached to the base body and movable between a locking position and a release position, the first engaging member being disposed on and movable with the movable member, the second engaging member being disposed on the blade storing carrier, one of the first engaging member and the second engaging member including a slot, the other of the first engaging member and the second engaging member including a projection which is releasably engaged within the slot; wherein when the movable member is located in the locking position and the projection is engaged within the slot, the blade storing carrier is undetachable from the housing, and when the movable member is located in the release position and the projection is disengaged from the slot, the blade storing carrier is detachable from the housing;

wherein the grip portion includes at least one recess configured for gripping;

wherein the housing further includes an arcuate concave, the arcuate concave extends in a direction lateral to a direction in which the recess extends, and the arcuate concave and the recess are in communication with each other.

2. The utility knife of claim 1, wherein the movable member and the base body are slidably sleeved with each other, and the movable member is slidable in a direction transverse to a direction in which the blade storing carrier is withdrawn.

3. The utility knife of claim 1, wherein the locking mechanism further includes an elastic member, and the elastic member is disposed between the housing and the movable member so that the movable member is biased in a direction toward the locking position.

4. The utility knife of claim 3, wherein the projection is hook-shaped and includes a first inclined portion, the blade storing carrier further includes a second inclined portion facing the first inclined portion, and when the blade storing carrier is inserted into the storage compartment in a direction toward the base body, the first inclined portion and the second inclined portion slide relative to each other so that the movable member moves toward the release position.

5. A utility knife, including:

a housing, defining an operation compartment and a storage compartment;

a blade holder, movably received within the operation compartment, configured to carry and hold a blade;

a blade storing carrier, movably received within the storage compartment, including a receiving portion and a grip portion which are connected with each other, the receiving portion configured to receive at least one spare blade, the grip portion being protrusive out of the housing; and a locking mechanism, including a base body, a movable member, a first engaging member and a second engaging member, the base body being disposed to the housing, the movable member being attached to the base body and movable between a locking position and a release position, the first engaging member being disposed on and movable with the movable member, the second engaging member being disposed on the blade storing carrier, one of the first engaging member and the second engaging member including a slot, the other of the first engaging member and the second engaging member including a projection which is releasably engaged within the slot wherein when the movable member is located in the locking position and the projection is engaged within the slot, the blade storing carrier is undetachable from the housing, and when the movable member is located in the release position and the projection is disengaged from the slot, the blade storing carrier is detachable from the housing;

wherein the utility knife further includes a trigger button, the trigger button is mounted to the housing and movable in a first direction, the blade holder includes a deformable portion, the deformable portion is resiliently deformable in the first direction, the deformable portion includes a positioning portion and a trigger portion, the positioning portion is configured to be connected with and hold the blade, the trigger portion is configured to be arranged to extend over the blade; the blade holder is movable to a predetermined position in a direction transvers to the first direction, and when the blade holder is located in the predetermined position, the trigger portion is located on a moving path in which the trigger button moves, and the trigger button is configured to be pressed to press and deform the trigger portion so that the positioning portion is disengaged from the blade.

6. The utility knife of claim 1, wherein the blade storing carrier further includes an urging portion, and the urging portion extends within the receiving portion and is configured to urge and abuts the at least one spare blade.

7. The utility knife of claim 6, wherein the urging portion includes a tab which is elastically deformable.

8. A utility knife, including:

a housing, defining an operation compartment and a storage compartment;

a blade holder, movably received within the operation compartment, configured to carry and hold a blade;

a blade storing carrier, movably received within the storage compartment, including a receiving portion and a grip portion which are connected with each other, the receiving portion configured to receive at least one spare blade, the grip portion being protrusive out of the housing; and a locking mechanism, including a base body, a movable member, a first engaging member and a second engaging member, the base body being disposed to the housing, the movable member being attached to the base body and movable between a locking position and a release position, the first engaging member being disposed on and movable with the movable member, the second engaging member being disposed on the blade storing carrier, one of the first engaging member and the second engaging member including a slot, the other of the first engaging member and the second engaging member including a projection which is releasably engaged within the slot wherein when the movable member is located in the locking position and the projection is engaged within the slot, the blade storing carrier is undetachable from the housing, and when the movable member is located in the release position and the projection is disengaged from the slot, the blade storing carrier is detachable from the housing;

wherein the locking mechanism further includes an elastic member, and the elastic member is disposed between the housing and the movable member so that the movable member is biased in a direction toward the locking position;

wherein the projection is hook-shaped and includes a first inclined portion, the blade storing carrier further includes a second inclined portion facing the first inclined portion, and when the blade storing carrier is inserted into the storage compartment in a direction toward the base body, the first inclined portion and the second inclined portion slide relative to each other so that the movable member moves toward the release position;

wherein the movable member and the base body are slidably sleeved with each other, and the movable member is slidable in a direction transverse to a direction in which the blade storing carrier is withdrawn; the grip portion includes at least one recess configured for gripping; the housing further includes an arcuate concave, the arcuate concave extends in a direction lateral to a direction in which the recess extends, and the arcuate concave and the recess are in communication with each other; the utility knife further includes a trigger button, the trigger button is mounted to the housing and movable in a first direction, the blade holder includes a deformable portion, the deformable portion is resiliently deformable in the first direction, the deformable portion includes a positioning portion and a trigger portion, the positioning portion is configured to be connected with and hold the blade, the trigger portion is configured to be arranged to extend over the blade; the blade holder is movable to a predetermined position in a direction transvers to the first direction, and when the blade holder is located in the predetermined position, the trigger portion is located on a moving path in which the trigger button moves, the trigger button is configured to be pressed to press and deform the trigger portion so that the positioning portion is disengaged from the blade; the blade storing carrier further includes an urging portion, and the urging portion extends within the receiving portion and is configured to urge and abuts the at least one spare blade; the urging portion includes a tab which is elastically deformable; the movable member includes two claws disposed through the housing and connected with a press button, the two claws are connected with the sleeve body, the press button is externally operable; the first engaging member includes the projection, the second engaging member includes the slot; the movable member further includes a sleeve body and two arm portions, the sleeve body is disposed around the base body, the two arm portions are separate and connected with the sleeve body, the projection is disposed between the two arm portions, the two arm portions and the projection define an insertion space, the blade storing carrier further includes an insertion section, the insertion section and the grip portion are respectively located at opposite ends of the blade storing carrier, the slot is disposed through the insertion section, the second inclined portion is disposed on a side of the insertion section opposite the grip portion, and the insertion section is insertable within the insertion space so that the projection is engaged within the slot; the receiving portion is located at an end of the blade storing carrier remote from the grip portion, the insertion section projects out of the receiving portion, the receiving portion is open at a side thereof opposite the grip portion and includes a notch, when the insertion section is inserted in the insertion space, and one of the two arm portions is located within the notch and within the receiving portion and is configured to block and restrict the at least one spare blade; the at least one recess includes two recesses, and the two recesses are respectively disposed at opposite sides of the grip portion.

* * * * *